US005084607A

United States Patent [19]

Shafer et al.

[11] Patent Number: 5,084,607

[45] Date of Patent: Jan. 28, 1992

[54] INTERFERENCE CONNECTION BETWEEN A HEATING ELEMENT AND BODY OF A GLOW PLUG

[75] Inventors: Scott F. Shafer; Garey A. Towe, both of Peoria, Ill.

[73] Assignee: Caterpillar Inc., Peoria, Ill.

[21] Appl. No.: 386,064

[22] Filed: Jul. 28, 1989

[51] Int. Cl.[5] ..... F23Q 7/22

[52] U.S. Cl. ..... 219/270; 219/523; 219/553; 123/145 A; 338/22 R; 361/266

[58] Field of Search ..... 219/270, 523, 553, 541, 219/267, 544, 505, 552, 530; 123/143 A, 145 A, 145 R; 338/22 R, 300, 330; 361/266

[56] References Cited

U.S. PATENT DOCUMENTS

| | | | |
|---|---|---|---|
| 2,024,387 | 12/1935 | Rabezzana | 123/145 A |
| 2,127,983 | 8/1938 | Nowosielski | 123/169 |
| 3,468,566 | 9/1969 | Nietzel | 285/341 |
| 3,749,980 | 7/1973 | Baxter | 317/98 |
| 3,992,043 | 11/1976 | Whitley | 285/39 |
| 4,252,091 | 2/1981 | Steinke | 123/145 A |
| 4,351,291 | 9/1982 | Mahaney | 123/145 A |
| 4,475,029 | 10/1984 | Yoshida et al. | 219/270 |
| 4,477,717 | 10/1984 | Walton | 219/267 |
| 4,556,242 | 12/1985 | Kowal et al. | 285/341 |
| 4,568,114 | 2/1986 | Konrad | 285/341 |
| 4,650,963 | 3/1987 | Yokoi | 219/270 |
| 4,661,686 | 4/1987 | Yokoi et al. | 219/270 |
| 4,929,813 | 5/1990 | Masaka et al. | 219/270 |

FOREIGN PATENT DOCUMENTS

| | | |
|---|---|---|
| 3620869 | 12/1987 | Fed. Rep. of Germany . |
| 419407 | 3/1967 | Switzerland . |

OTHER PUBLICATIONS

Mechanical Engineering Design, Third Edition, By: Joseph Edward Shigley, McGraw-Hill Book Company, Published 1977, Excerpts: pp. 542-544.

Machinery's Handbook for Machine Shop and Drafting Room, 15th Edition, By: Erik Obert et al., The Industrial Press, New York, U.S.A. Published 1957, Excerpts: pp. 1411-1424.

*Primary Examiner*—Bruce A. Reynolds
*Assistant Examiner*—Tu Hoang
*Attorney, Agent, or Firm*—Anthony N. Woloch

[57] ABSTRACT

An improved mechanical joint structure is provided and adapted for positively retaining a heating element within a bore of a body of a glow plug. The glow plug includes a body, a heating element and a ferrule. The ferrule is sealingly positioned radially between an internal surface of the body bore and a peripheral surface of the heating element. The glow plug further includes a compressing structure for positively compressing an internal surface of the ferrule against the peripheral surface of the heating element in response to the heating element being forced into the body bore by, for example, the gas pressure developed in an operating engine combustion chamber.

Unlike conventional brazed or interference joints used in typical glow plugs, the present invention provides a normal force ($F_n$), for sealing the heating element, and an axially-directed frictional force ($F_f$), for retaining the heating element, which both increase as the heating element is forced deeper into the body bore.

15 Claims, 6 Drawing Sheets

38
14'
48
48
18'
122
110
114
62'
118
50
30
66'
58
82'
26'
130
10'
138
22
54

INTERFERENCE CONNECTION BETWEEN A HEATING ELEMENT AND BODY OF A GLOW PLUG

TECHNICAL FIELD

The present invention relates generally to a mechanical joint structure and, more particularly to mechanical joint structure for sealingly connecting a heating element to a body of a glow plug.

BACKGROUND ART

There are various known ways to connect a heating element to the body of a glow plug. As shown in U.S. Pat. No. 3,749,980 issued to Baxter on July 31, 1973, the heating element of some glow plugs includes a refractory metal sheath or sleeve which is brazed to a metallic body or housing. The above brazed joint merely provides a shearing force, in a direction axial to the joint, as the only means of retaining the heating element to the glow plug body. When such glow plugs are used in a combustion chamber of a diesel-cycle internal combustion engine, the aforementioned joint is periodically subjected to very high combustion chamber gas pressures and temperatures which can cause failure of the brazed joint. Such failure eventually permits leakage of combustion chamber gas and/or results in breakage of the electrical circuit in the glow plug.

Moreover, such a heating element having a metallic outer peripheral surface is susceptible to early failure caused by corrosion and oxidation particularly when the heating element is continuously energized in a diesel-cycle internal combustion engine in order to ignite non-autoignitable fuels such as methanol, ethanol or gaseous fuels. As shown in U.S. Pat. No. 4,661,686 issued to Yokoi et al. on Apr. 28, 1987, it is known to braze a heating element having an outer peripheral surface made from a ceramic material, such as silicon nitride ($Si_3Ni_4$). Such a ceramic heating element may be relatively more corrosion and oxidation resistant compared to a metallic outer peripheral surface. However, in addition to the aforementioned problems generally associated with brazing, it is usually more difficult to braze a heating element made of a ceramic material (in contrast to a heating element made from a metallic material) to a metallic body of a glow plug because of the dissimilarity of the materials being brazed.

As shown in U.S. Pat. No. 4,252,091 issued to Steinke on Feb. 24, 1981, and U.S. Pat. No. 4,477,717 issued to Walton on Oct. 16, 1984, another way of connecting a heating element to a glow plug body is to use an interference fit. In Steinke, a metallic sheath of a heating element is press fitted directly into a bore of a glow plug body. In Walton, an end of a metallic sheath of a heating element is crimped onto a compressible silicon washer which is then pressed fitted into a bore of a glow plug body. The above interference joints are provided with a relatively constant frictional force which, if subjected to enough combustion chamber gas pressure, can be overcome and permit uncontrolled relative movement between the heating element and the housing. Such uncontrolled relative movement can lead to leakage of combustion chamber gas and/or breakage of the electrical circuit in the glow plug.

As shown in U.S. Pat. No. 3,992,043 issued to Whitley on Nov. 16, 1976, it is known to use a ferrule and one or more nuts to connect a flareless tube to a body part or fitting. In Whitley, a tapered peripheral end of a ferrule engages a frustoconically-shaped mouth of a channel in a body part. As shown in U.S. Pat. No. 4,556,242 issued to Kowal et al. on Dec. 3, 1985, and U.S. Pat. No. 4,568,114 issued to Konrad on Feb. 4, 1986, a ferrule may also include a means for biting, digging or cutting into a flareless tube.

To the Applicant's knowledge, the teachings of Whitley, Kowal et al. or Konrad have never been applied to the problem of connecting a heating element to a glow plug body. Moreover, applying the biting, digging or cutting means of Kowal et al. or Konrad to retain a heating element to a glow plug body wherein at least the outer peripheral surface of the heating element is a ceramic material may cause cracking or unacceptable stress concentration on the heating element.

The present invention is directed to overcoming one or more of the problems as set forth above.

DISCLOSURE OF THE INVENTION

In one aspect of the present invention a mechanical joint structure is disclosed comprising a body, a member and a ferrule. The body defines a bore having an internal surface and an opening. The member has a peripheral surface and is positioned in the body bore in spaced relation to the internal surface of the body bore. The ferrule is sealingly positioned between the internal surface of the body bore and the peripheral surface of the member. The ferrule has a peripheral surface and also defines a main bore having an internal surface. The mechanical joint structure further includes a compressing means for compressing the internal surface of the ferrule against the peripheral surface of the member in response to the member being forced into the body bore.

In another aspect of the present invention a ferrule is disclosed which includes a first end portion and an enlarged second end portion. The first end portion has a generally tapered peripheral surface and also defines a main bore having an internal surface and a shoulder formed thereon. The second end portion of the ferrule has an annular seat formed thereon which generally oppositely faces the first end portion of the ferrule. The second end portion further includes a counterbore coaxial with and adjacent to the main bore.

In another aspect of the present invention a glow plug is disclosed comprising a body, a heating element and a ferrule. The body defines a bore having an internal surface and an opening. The heating element has a peripheral surface and is positioned in the body bore in spaced relation to the internal surface of the body bore. The ferrule is sealingly positioned between the internal surface of the body bore and the peripheral surface of the heating element. The ferrule has a peripheral surface and also defines a main bore having an internal surface. The glow plug further includes a compressing means for compressing the internal surface of the ferrule against the peripheral surface of the heating element in response to the heating element being forced into the body bore.

BEST MODE FOR CARRYING OUT THE INVENTION

Figure 1:
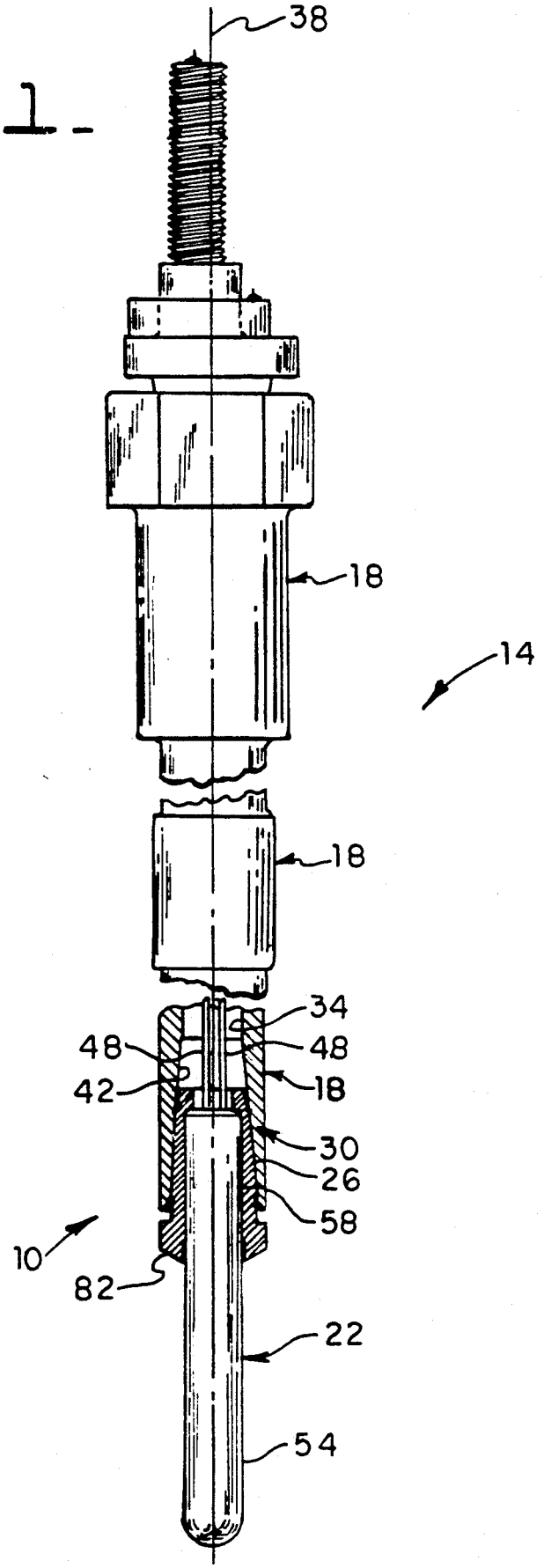
FIG. 1 is a diagrammatic cross-sectional view of a first exemplary embodiment of the present invention.

Referring to FIGS. 1-7, wherein similar reference characters designate similar elements or features throughout those figures, there are shown two exemplary embodiments of the mechanical joint structure of the present invention. Although each mechanical joint structure is illustrated for an electrically-energizable glow plug adapted for use in an internal combustion engine, it should be kept in mind that the present invention is also applicable to many other various types of structures having a pair of telescopically assembled elements which require a sealed joint therebetween.

Referring to FIGS. 1-5, a first embodiment of the mechanical joint structure 10 is shown for connecting various components of a glow plug 14.

The glow plug 14 includes a rigid body 18, an elongated rigid electrical-resistance heating element or member 22, a rigid but relatively-ductile elongated ferrule 26, and a compressing means or structure 30.

Preferably, the body 18 has a ductility which is much less than the ductility of the ferrule 26. If the cross-sectional wall thicknesses of the body 18 and ferrule 26 along the surfaces of mutual contact are chosen to be about the same, the body 18 is preferably composed of a material having a relatively higher tensile yield strength compared to the compressive yield strength of the ferrule 26. For example, the body 18 may be composed of a SAE 4140 steel having a tensile yield strength of about 150,000 pounds-force per square inch (psi).

Figure 3:
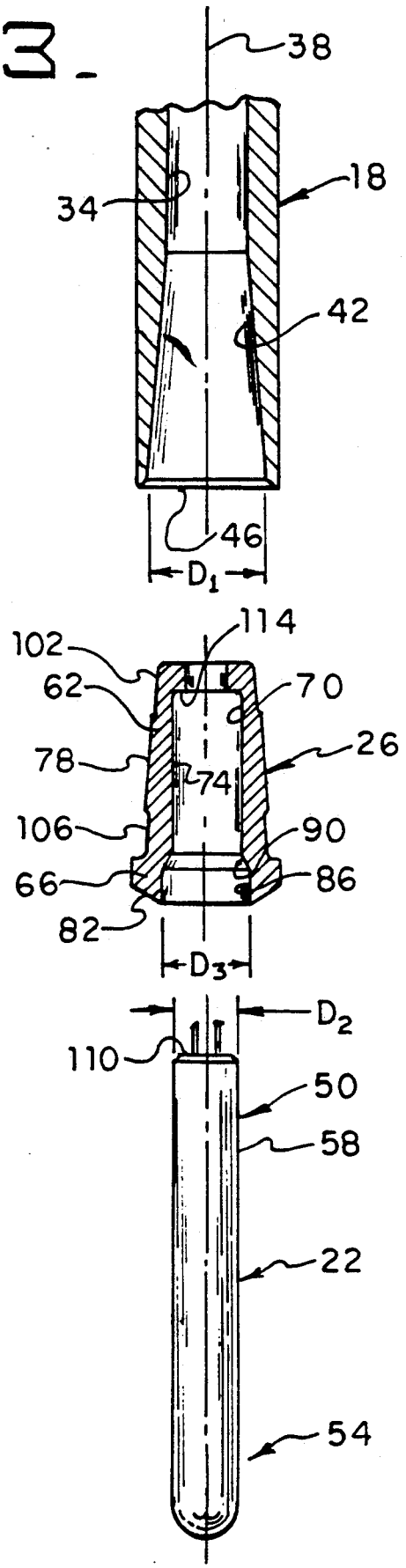
FIG. 3 is a diagrammatic enlarged exploded partial view of the embodiment of FIG. 1.
Figure 5:
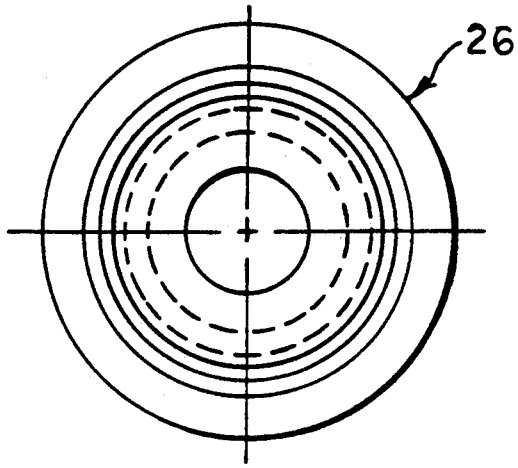
FIG. 5 is a diagrammatic end view of FIG. 4 taken along line V—V.

As shown in FIG. 3, the body 18 defines a generally cylindrical bore 34 having a longitudinal axis 38. One end portion of the body bore 34 has a generally tapered annular internal surface 42 and an opening 46. Preferably, the tapered annular internal surface 42 of the body bore 34 has a diameter $D_1$ which, in a direction along axis 38, constantly increases towards the body bore opening 46.

The structure of the heating element 22, per se, may be any one of a number of different known embodiments (including, but not limited to, those generally shown in U.S. Pat. No. 3,749,980 or U.S. Pat. No. 4,661,686 or U.S. Pat. No. 4,252,091) without departing from the scope of the present invention. Preferably, the exterior surface of the heating element 22 is composed of a material which is also relatively less ductile than the ductility of the ferrule 26. Preferably, the exterior surface of the heating element is composed of a ceramic material (such as, for example, aluminum oxide or chromium oxide or silicon nitride). Such ceramic materials advantageously provide a compressive strength greater than about 300,000 psi which should be relatively higher than the selected compressive yield strength of the ferrule 26. Such ceramic materials also provide adequate corrosion and oxidation resistance when the heating element is heated to an elevated temperature and exposed to the severe operating conditions of a combustion chamber of an internal combustion engine. Moreover, in order to avoid undesirable stress concentrators on the exterior surface of the heating element, that exterior surface is preferably formed in the shape of a generally smooth and imperforate cylinder having a rounded closed free end. Preferably, as shown in FIGS. 1 and 2, the interior of the heating element includes an electrical resistance filament 48 which forms part of an electrical circuit adapted to heat the glow plug 14 when electrical current is applied thereto.

Figure 2:
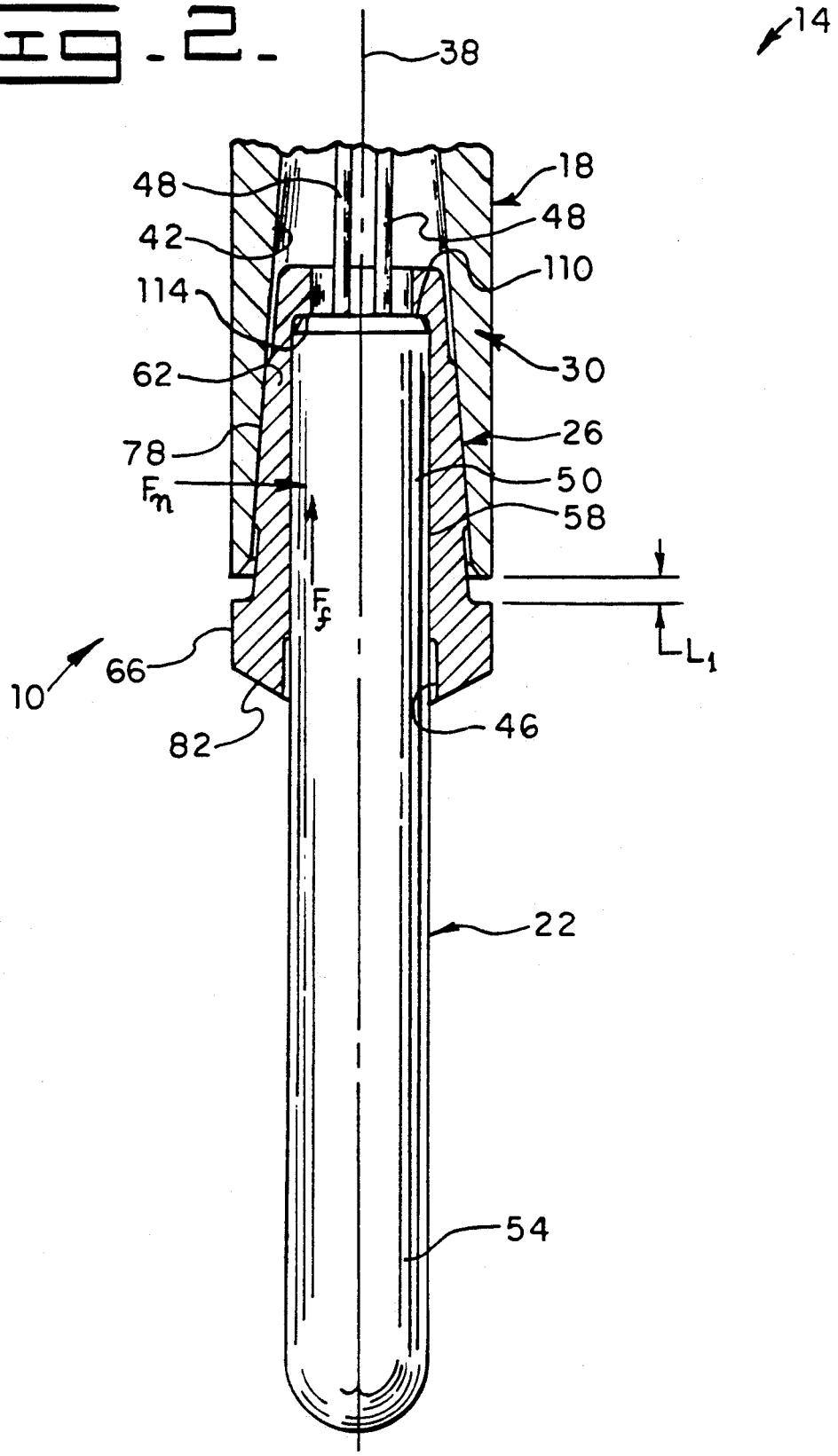
FIG. 2 is a diagrammatic enlarged partial view of FIG. 1.

As shown in FIGS. 2 and 3, the heating element 22 has first and second end portions 50,54. The first end portion 50 of the heating element 22 has a generally cylindrical peripheral surface 58 which, as shown in FIGS. 1 and 2, is positioned in the body bore 34 in radially-spaced relation to the tapered annular internal surface 42 of the body bore 34. As shown in FIG. 3, the peripheral surface 58 has a diameter $D_2$. As shown in FIGS. 1 and 2, the second end portion 54 of the heating element 22 projects outwardly from the body bore opening 46.

Preferably, the ferrule 26 is composed of a material which is relatively more ductile than the individual ductilities of the body 18 and the heating element 22. For example, if the cross-sectional wall thicknesses of the body 18 and ferrule 26 along the surfaces of mutual contact are chosen to be about the same, the ferrule may be composed of a relatively soft low-carbon steel such as SAE 1018 steel having a compressive yield strength of about 32,000 psi. As shown in FIGS. 1 and 2, the ferrule 26 is sealingly positioned radially between the tapered annular internal surface 42 of the body bore 34 and the cylindrical peripheral surface 58 of the heating element 22.

Figure 4:
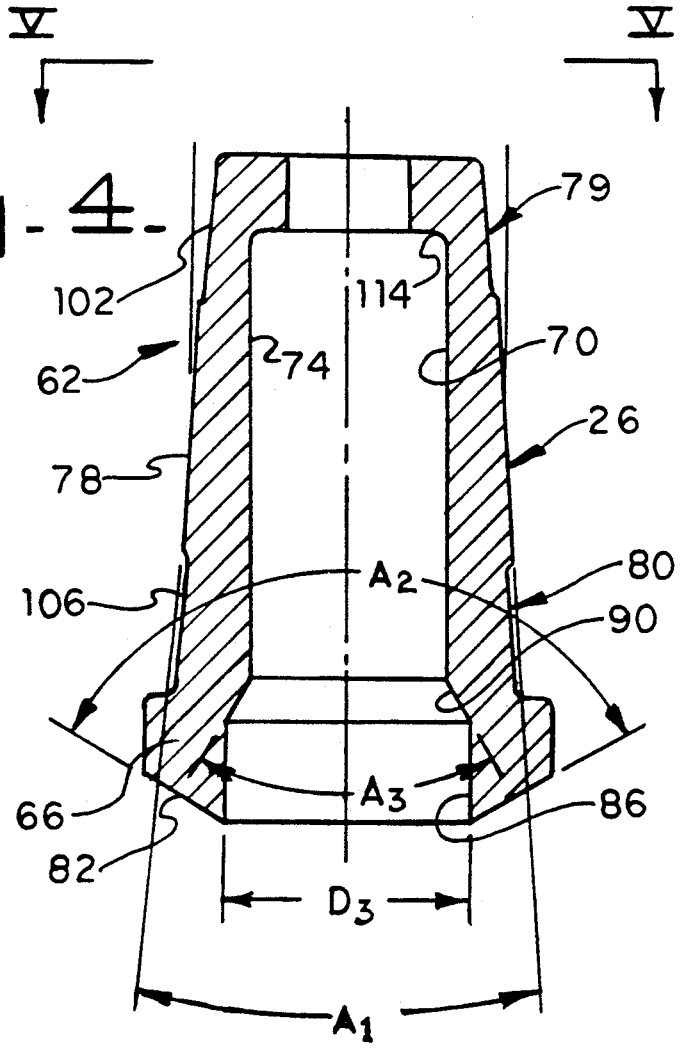
FIG. 4 is a diagrammatic enlarged isolated cross-sectional view of the ferrule shown in FIGS. 1-3.

As shown in FIGS. 1-5, the ferrule 26 includes a first end portion 62 positionable in the body bore 34 and an enlarged second end portion 66 positionable outside of the body bore 34. As shown in FIGS. 3 and 4, the ferrule 26 further defines a main bore 70 which is coaxial with the body bore 34 and includes a generally cylindrical internal surface 74. The internal surface 74 directly envelopes the peripheral surface 58 of the first end portion 50 of the heating element 22. Preferably, in their free (i.e., unassembled) states, there is a generally a sliding fit between the heating element 22 and the ferrule 26. For example, in their free states, the nominal diametrical clearance between the inside diameter of the main bore 70 of the ferrule 26 and the outside diameter $D_2$ of the peripheral surface 58 of the heating element 22 is preferably about 0.0254 millimeters (0.001 inches).

As shown in FIG. 4, the first end portion 62 of the ferrule 26 includes a generally tapered annular peripheral surface 78 having first and second oppositely facing end portions 79,80. Preferably, the tapered peripheral surface 78 of the ferrule 26 has an included angle $A_1$ which is less than about 10° and, preferably, is about 8° in order to provide an adequate wedging effect when the ferrule 26 is inserted into the body bore 34. The tapered annular peripheral surface 78 of the ferrule 26 is preferably complimentary with and directly engages the tapered annular internal surface 42 of the body bore 34 by an interference fit. Moreover, measured along the axis 38 shown in FIGS. 2 and 3, the orthographically-projected axial length of the tapered annular internal surface 42 of the body bore 34 is preferably longer than the orthographically-projected axial length of the tapered annular peripheral surface 78 of the ferrule 26.

As shown in FIGS. 3 and 4, the second end portion 66 of the ferrule 26 has an tapered annular seat 82 formed thereon which generally oppositely faces the first end portion 62 of the ferrule 26. The seat 82 preferably has an included angle $A_2$ of about 120°. The seat 82 of the ferrule 26 is adapted to sealingly seat the glow plug 14 in, for example, a bore of a cylinder head wall or boss of an internal combustion engine (not shown).

As shown in FIG. 2, the enlarged second end portion 66 of the ferrule 26 is axially spaced from the body 18, and more particularly the body bore opening 46, according to a preselected axial length $L_1$ when the mechanical joint structure 10 is assembled. This arrangement ensures that the desired interference fit between the body 18, the ferrule 26 and the heating element 22 will be achieved and maintained before the enlarged second end portion 66 can contact and "bottom out" on the mouth of the body bore 34.

As shown in FIG. 3, the main bore 70 of the ferrule 26 includes a counterbore 86 formed in the second end portion 66 of the ferrule 26 which is coaxial with the main bore 70 along axis 38. As shown in FIG. 3, the counterbore 86 has a diameter $D_3$ which is greater than the diameter $D_2$ of the peripheral surface 58 of the first end portion 50 of the heating element 22 by a preselected diametrical clearance ($D_3$ minus $D_2$). This diametrical clearance is preferably chosen large enough to prevent the second end portion of the ferrule 26 from pinching (i.e., concentrating the load transferred to) the peripheral surface 58 of the heating element 22 when the assembled glow plug 14 is seated on its annular seat 82. The ferrule 26 further includes a tapered annular surface 90 formed between the counterbore 86 and the main bore 70 of the ferrule 26. Preferably, as shown in FIG. 4, the tapered annular surface 90 has an included angle $A_3$ of about 60° to provide a relatively gradual transition from the counterbore 86 to the main bore 70.

Preferably, as shown in FIGS. 3 and 4, the opposite end portions 79,80 of the tapered annular peripheral surface 62 of the ferrule 26 further define a pair of annular recesses or reliefs 102,106. The recesses 102,106 of the ferrule 26 provide preselected radial clearances relative to the internal surface 42 of the body bore 34. The radial clearances preferably should be chosen large enough to prevent the recesses 102,106 from at least initially contacting the internal surface 42 of the body bore 34. This arrangement ensures that, in the assembled joint structure 10, the load transferred from the body 18 is evenly distributed along the peripheral surface 78 of the ferrule 26.

As shown in FIGS. 2 and 3, the compressing means 30 includes an annular shoulder 110 formed on the first end portion 50 of the heating element 22 and a complementary annular shoulder 114 formed at the bottom of the main bore 70 of the ferrule 26. As shown in FIGS. 1 and 2, the shoulder 110 of the heating element 22 continuously engages the shoulder 114 of the ferrule 26.

Figure 7:
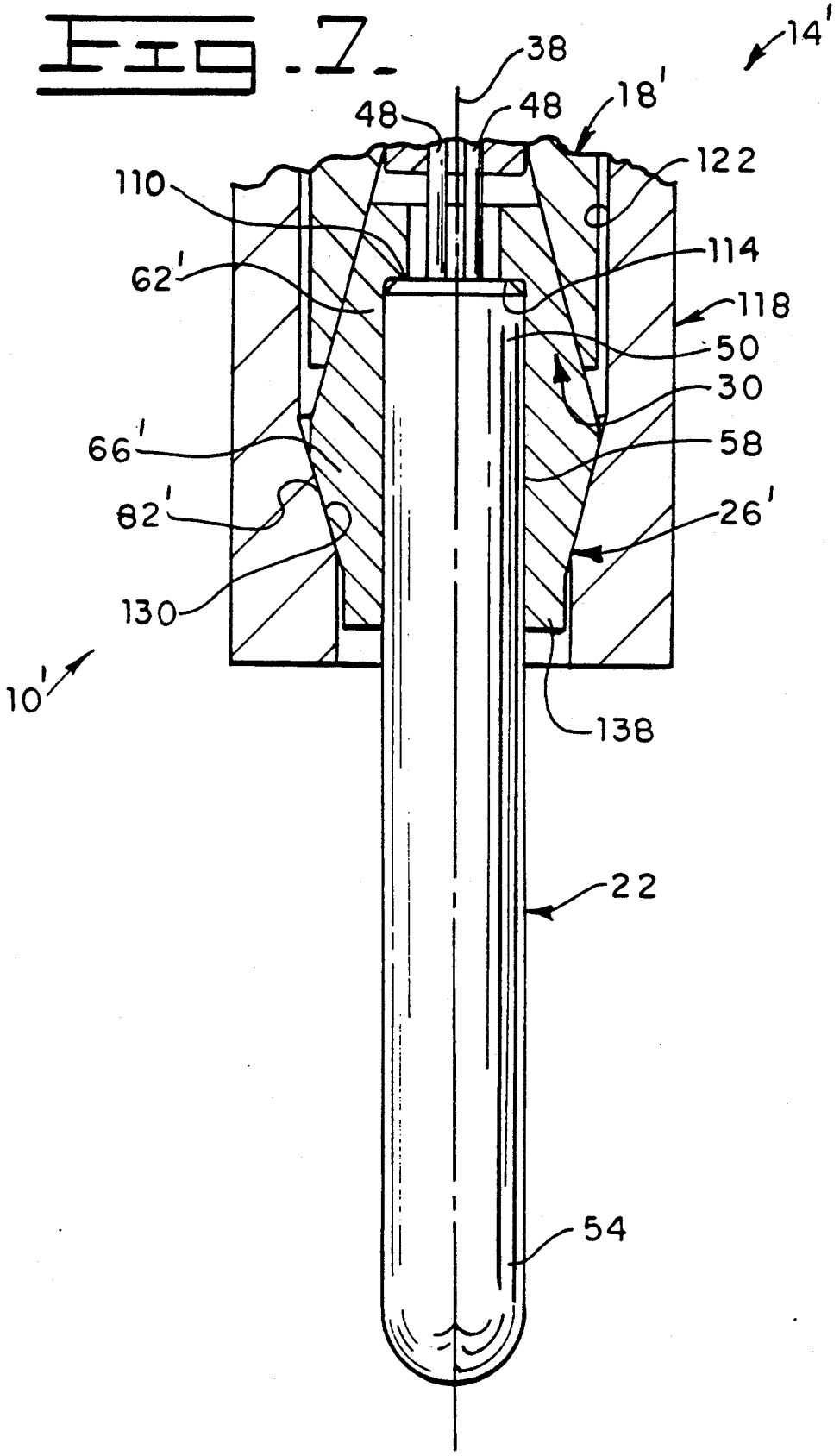
FIG. 7 is a diagrammatic enlarged partial view of FIG. 6.
Figure 6:
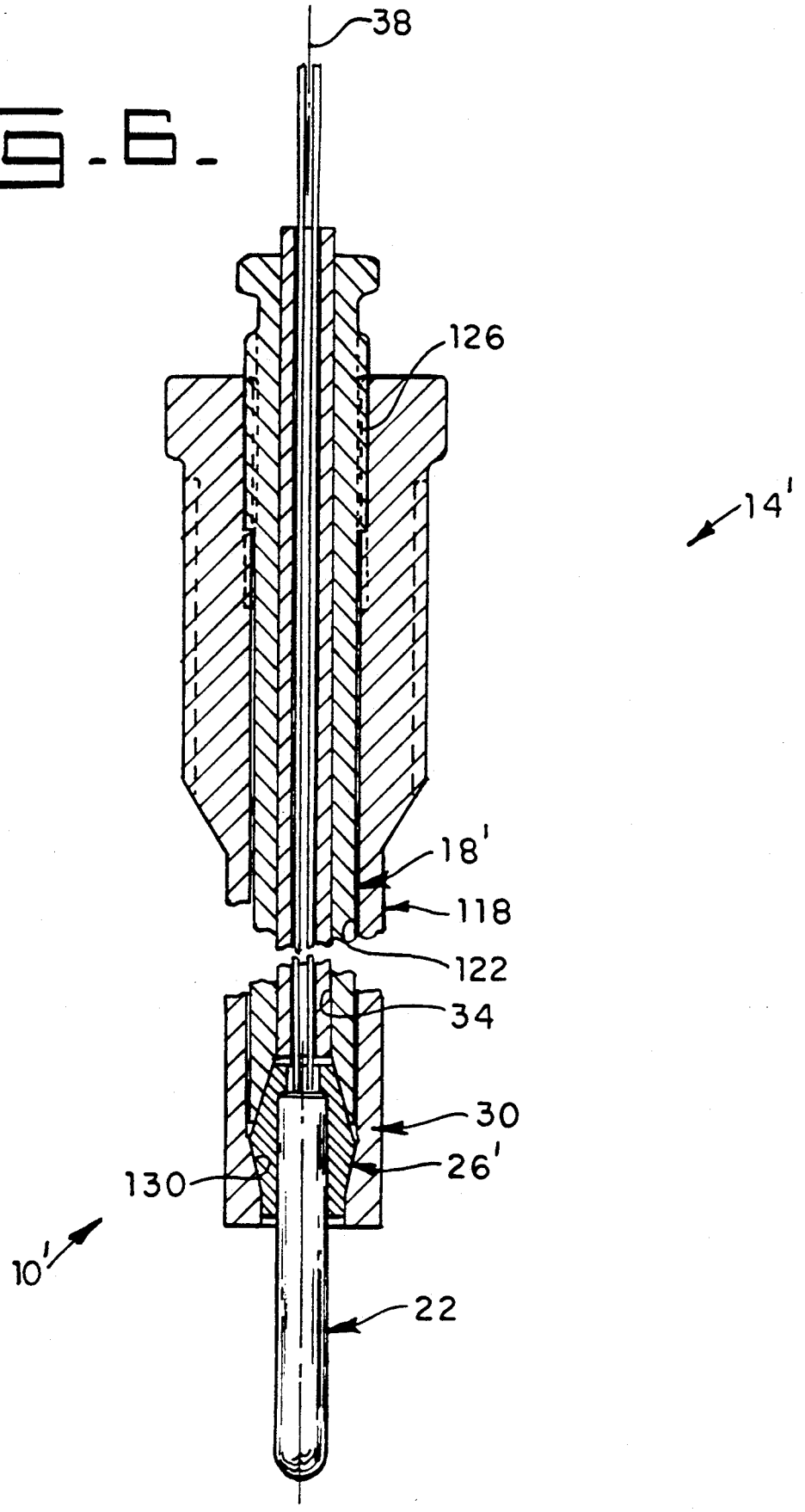
FIG. 6 is a diagrammatic cross-sectional view of a second exemplary embodiment of the present invention.

FIGS. 6–7 illustrate a second embodiment of the present invention for a glow plug 14' which is generally similar to the first embodiment except that a somewhat different body 18' and ferrule 26' are provided. Moreover, the glow plug 14' further includes an elongated housing 118. The housing 118 defines a longitudinal bore 122 which telescopically receives the body 18' and is releasably connected thereto by, for example, a threaded connection 126. In this arrangement, the housing 118 is adapted to function as a boss in the cylinder head, at a location where no cylinder head wall is available, for mounting the glow plug 14' and also for sealing the glow plug 14' from engine coolant which may circulate in the cylinder head.

As shown in FIG. 7, the longitudinal bore 122 of the housing 118 is coaxial with the body bore 34 and has a generally tapered annular internal shoulder 130 therein. The ferrule 26' includes a first end portion 62' positioned in the body bore 34 and a second end portion 66' positioned outside of the body bore 34.

The second end portion 66' of the ferrule 26' has a generally tapered annular peripheral surface 134 formed thereon which is complementary with and engages the internal shoulder 130 of the housing bore 122. The peripheral surface 134 has a diameter which, along the axis 38, increases towards the body bore opening 46. Moreover, the second end portion 66' of the ferrule 26' has a radially recessed end 138 which is radially spaced from the surrounding housing 118.

Industrial Applicability

The first embodiment of the mechanical joint structure 10 is illustrated for a glow plug 14 which is adapted to be installed in a bore of a wall or boss of a cylinder head of an internal combustion engine. The second embodiment of the mechanical joint structure 10' is illustrated for a glow plug 14' which is also adapted to be installed in a cylinder head but may require a protective housing 118 in order to isolate the glow plug 14' from engine coolant circulating through passages in the cylinder head.

In the first embodiment of the mechanical joint structure 10 shown in FIG. 3, the first end portion 50 of the heating element 22 is slipped into an entrance opening of the main bore 70 of the ferrule 26 until the shoulder 110 of the heating element 22 contacts the shoulder 114 of the ferrule 26. The portion of the electrical resistance filament 48 extending out of the heating element 22 is fed through an exit opening of the main bore 70.

The ferrule/heating element subassembly 26,22 is then inserted into the body bore opening 46 and, by using an assembly fixture, is pressed radially outwardly against the internal surface 42 of the body bore 34. For example, the assembly fixture can have a configuration generally similar to the housing 118 shown in FIG. 6. The annular seat 82 of the ferrule 26 is seated inside the longitudinal bore of the assembly fixture to hold the ferrule/heating element 26,22 stationary and then the body is threaded into the assembly fixture which draws the internal surface 42 of the body 18 over the peripheral surface 78 of the ferrule 26. This step of pressing continues until a desired interference fit between the peripheral surface 78 of the ferrule 26 and the internal surface 42 of the body 18 is achieved.

As previously mentioned, the ferrule 26 has a ductility which is greater than the individual ductilities of the tapered annular internal surface 42 of the body 18,18' and the cylindrical peripheral surface 58 of the member 22. As the ferrule/heating subassembly is pressed deeper and deeper into the body bore 34, the relatively higher strength body 18 and heating element 22 squeeze the ferrule 26 that is sandwiched therebetween and preferably cause plastic deformation of the ferrule 26. Consequently, the tapered annular peripheral surface 62 of the ferrule 26,26' sealingly conforms to the tapered annular internal surface 42 of the body 18,18'. Moreover, the cylindrical internal surface 70 of the ferrule 26,26' sealingly conforms to and clamps tightly around the cylindrical peripheral surface 58 of the heating element 22.

Compression of the relatively soft ferrule onto the peripheral surface 58 of the heating element serves to create an adequate combustion gas seal. Sufficient deformation of the ferrule to provide an adequate combustion chamber gas seal is accomplished with a clamping load of, for example, about 8900 newtons (about 2000 pounds-force which, for example, may be achieved by providing 150 inch-pounds torque on a ⅜- 24 thread between the body 18 and the assembly fixture). Such deformation of the ferrule 26 ensures that the reaction force from the body due to the interference fit is evenly distributed though the peripheral surface 78 of the ferrule 26 and thence evenly distributed to the peripheral surface 58 of the heating element 22. Consequently, during the step of pressing, the internal surface 74 of the ferrule 26 clamps tighter and tighter circumferentially around the peripheral surface 58 of the heating element 22. After the ferrule/heating element subassembly has been permanently attached to the body 18 by the preselected interference fit, the glow plug 14 is removed (i.e., unthreaded) from the assembly fixture.

In the second embodiment of the mechanical joint structure 10' shown in FIGS. 6 and 7, the first end portion 50 of the heating element 22 is slipped into an entrance opening of the main bore 70 of the ferrule 26' until the shoulder 110 of the heating element 22 contacts the shoulder 114 of the ferrule 26'. The portion of the electrical resistance filament 48 extending out of the heating element 22 is fed through an exit opening of the main bore 70.

The ferrule/heating element subassembly 26',22 is then inserted into the bore 122 of the housing 118 and the seat 82' of the ferrule 26' is seated on the internal shoulder 130 of the housing 118 to hold the ferrule/-heating element subassembly stationary. The body 18' is then inserted into the housing bore 122 and threaded into the housing 118 via the threaded connection 126. The internal surface 42 of the body 18' is drawn over the peripheral surface 78 of the ferrule 26'. This step of pressing continues until a desired interference fit between the peripheral surface 78 of the ferrule 26' and the internal surface 42 of the body 18' is achieved.

In known glow plugs where the heating element is brazed to the body, a generally constant axial shearing strength in the brazed joint is the only means of retaining the heating element to the body in opposition to the fluctuating gas pressure existing in an operating engine combustion chamber. In the present invention, retention as well as sealing of the heating element 22 to the body 18 is improved compared to prior art glow plugs due to the positive clamping nature of the body/ferrule/heating element joint.

As shown in FIG. 2, the ferrule 26,26' exerts not only an axial frictional force $F_f$ acting in a direction axial to the peripheral surface 58 of the heating element 22 for retention of the heating element 22 but also a normal force $F_n$ acting in a direction perpendicular to and uniformly distributed over a preselected portion of the peripheral surface 58 for effective sealing of the interface between the heating element 22 and the glow plug body 18,18'. The engaged shoulders 110, 114 of the compressing means 30 in combination with the wedged complementary tapered surfaces 42,78 cause an increase in the compressive normal force $F_n$ acting radially-inwardly against the peripheral surface 58 of the heating element 22 whenever the heating element 22 is forced deeper into the body bore 34.

For example, when the glow plug 14,14' is used in an operating internal combustion engine, elevated gas pressure acting on the heating element 22 causes an increased normal force $F_n$ between the ferrule 26,26' and the heating element 22 resulting in improved sealing between that interface. Moreover, since the axial frictional force $F_f$ is a function of the normal force $F_n$ multiplied by a factor known as the coefficient of friction $\mu$, an increase in the above normal force $F_n$ results in an increased axial frictional force $F_f$ between the ferrule 26 and the heating element 22. This increased axial frictional force $F_f$ results in improved retention of the heating element 22 to the glow plug body 18,18'.

Another advantage of the improved joint structure 10,10' is the ease of connecting the heating element 22 to the glow plug body 18,18' even when the materials chosen for the heating element and body are dissimilar, such as, for example, metallic versus ceramic.

Other aspects, objects, and advantages of this invention can be obtained from a study of the drawings, the disclosure, and the appended claims.

We claim:

1. A glow plug adapted for an internal combustion engine comprising:

a body defining a bore having a tapered internal surface and an opening, said tapered internal surface having a diameter which increases towards the opening of the body bore;

an elongated heating element having first and second end portions, said first end portion of the heating element having a peripheral surface positioned in the body bore in spaced relation to the internal surface of the body bore, said second end portion of the heating element being positioned outside of the body bore opening;

a ferrule sealingly positioned radially between the internal surface of the body bore and the peripheral surface of the heating element, said ferrule having a tapered peripheral surface and defining a main bore having an internal surface, said tapered peripheral surface of the ferrule being complementary relative to the tapered internal surface of the body bore, said tapered peripheral surface of the ferrule being connected to the tapered internal surface of the body bore by an interference fit; and compressing means for radially-inwardly compressing the internal surface of the ferrule against the peripheral surface of the first end portion of the heating element in response to the heating element being forced into the body bore, said compressing means including a shoulder formed on the first end portion of the heating element and a shoulder formed in the main bore of the ferrule, said shoulder of the heating element engaging the shoulder of the ferrule.

2. The glow plug of claim 1 wherein said ferrule includes a first end portion positioned in the body bore and an enlarged second end portion positioned outside of the body bore, said second end portion of the ferrule having an annular seat formed thereon and generally oppositely facing the first end portion of the ferrule, said seat of the ferrule being adapted to sealingly seat the glow plug in said internal combustion engine.

3. The glow plug of claim 2 wherein said enlarged second end portion of the ferrule is spaced from the body bore opening.

4. The glow plug of claim 2 wherein said main bore of the ferrule further includes a counterbore formed in the second end portion of the ferrule and having a diameter which is greater than a diameter of the peripheral surface of the first end portion of the heating element by a preselected diametrical clearance.

5. The glow plug of claim 4 wherein said ferrule further includes a tapered annular internal surface formed between said counterbore and the main bore of the ferrule.

6. The glow plug of claim 5 wherein said tapered annular internal surface between the main bore and the counterbore of the ferrule has an included angle of about 60°.

7. The glow plug of claim 1 wherein said ferrule includes a first end portion positioned in the body bore and a second end portion projecting outside of the body bore, said peripheral surface of the ferrule being located radially around the first end portion and defining a pair of annular recesses formed at opposite ends of the first end portion of the ferrule, said recesses of the ferrule providing a preselected radial clearance relative to the internal surface of the body bore.

8. The glow plug of claim 1 further including an elongated housing defining a longitudinal housing bore having an internal shoulder therein, said housing bore telescopically receiving the body and being releasably connected thereto, said ferrule including a first end portion positioned in the body bore and a second end portion positioned outside of the body bore, said second end portion of the ferrule having a peripheral surface which is complementary with and engages the internal shoulder of the housing bore.

9. The glow plug of claim 8 wherein said second end portion of the ferrule has a radially recessed end radially spaced from the housing.

10. The glow plug of claim 8 wherein said peripheral surface of the second end portion of the ferrule is generally tapered and has a diameter which increases towards the body bore opening.

11. The glow plug of claim 1 wherein the peripheral surface of the heating element is free of any other connecting structure relative to the ferrule and the body.

12. The glow plug of claim 1 wherein the peripheral surface of the heating element is composed of a ceramic material and the internal surface of the body bore is composed of a metallic material.

13. The glow plug of claim 1 wherein said main bore of the ferrule provides a generally sliding fit relative to the peripheral surface of the heating element when the ferrule and heating element exist in their free states prior to assembly of the glow plug.

14. An electrically-energizable glow plug adapted for an internal combustion engine comprising:

a rigid metallic body defining a bore having a longitudinal axis, a generally tapered annular internal surface and an opening, said tapered annular internal surface of the body bore having a diameter ($D_1$) which constantly increases towards the body bore opening;

an elongated rigid ceramic electrical resistance heating element having first and second end portions, said first end portion of the heating element having a generally cylindrical peripheral surface positioned in the body bore in radially-spaced relation to the tapered annular internal surface of the body bore, said second end portion of the heating element being positioned outside of the body bore opening;

an elongated ductile metallic ferrule sealingly positioned radially between the tapered annular internal surface of the body bore and the peripheral surface of the heating element, said ferrule having a generally tapered annular peripheral surface and defining a main bore coaxial with the body bore, said main bore of the ferrule having a generally cylindrical internal surface, said tapered annular peripheral surface of the ferrule being complementary with and engaging the tapered annular internal surface of the body bore by an interference fit, said ferrule having a ductility greater than the individual ductilities of the body and the heating element; and compressing means for radially-inwardly compressing the internal surface of the ferrule main bore directly against the peripheral surface of the first end portion of the heating element in response to the heating element being forced into the body bore, said compressing means including a shoulder formed on the first end portion of the heating element and a shoulder formed in the main bore of the ferrule, said shoulder of the heating element engaging the shoulder of the ferrule.

15. A glow plug adapted for an internal combustion engine comprising:

a body defining a body bore having a tapered internal surface and an opening, said tapered internal surface having a diameter which increases towards the opening of the body bore;

an elongated heating element having first and second end portions, said first end portion of the heating element having a peripheral surface positioned in the body bore in spaced relation to the tapered internal surface of the body bore, said second end portion of the heating element being positioned outside of the body bore opening; and a ferrule sealingly positioned radially between the internal surface of the body bore and the peripheral surface of the heating element, said ferrule having a tapered peripheral surface and defining a main bore having an internal surface, said tapered peripheral surface of the ferrule being complementary relative to the tapered internal surface of the body bore, said tapered peripheral surface of the ferrule being connected to the tapered internal surface of the body bore by an interference fit, said ferrule further including a first end portion positioned in the body bore and an enlarged second end portion positioned outside of the body bore, said second end portion of the ferrule having an annular seat formed thereon and generally oppositely facing the first end portion of the ferrule, said seat of the ferrule being adapted to sealing seat the glow plug in said internal combustion engine;

compressing means for radially-inwardly compressing the internal surface of the ferrule against the peripheral surface of the first end portion of the heating element in response to the heating element being forced into the body bore, said compressing means including a shoulder formed on the first end portion of the heating element and a shoulder formed in the main bore of ferrule, said shoulder of the heating element engaging the shoulder of the ferrule.

* * * * *

UNITED STATES PATENT AND TRADEMARK OFFICE

CERTIFICATE OF CORRECTION

PATENT NO. : 5,084,607

DATED : January 28, 1992

INVENTOR(S) : SCOTT F. SHAFER ET AL.

It is certified that error appears in the above-identified patent and that said Letters Patent is hereby corrected as shown below:

On the title page: Item [75]: "Inventors", delete "Garey" and insert --Carey--.

"ABSTRACT", the two separate paragraphs should be formed into a single paragraph.

Claim 1, column 8, line 27, after "defining a", insert --body--;
column 8, line 34, after "relation to the", insert --tapered--;

Claim 14, column 9, line 56, after "defining a", insert --body--;
column 9, line 59, after "diameter", delete "($D_1$)";
column 10, line 14, after "greater than", delete "the".

Claim 15, column 10, line 40, after "between the", insert --tapered--;
column 10, line 56, delete "sealing" and insert --sealingly--;

Signed and Sealed this

Twenty-ninth Day of June, 1993

*Attest:*

Michael K. Kirk

MICHAEL K. KIRK

*Attesting Officer*

*Acting Commissioner of Patents and Trademarks*